United States Patent [19]

Frankosky et al.

[11] Patent Number: 5,064,703

[45] Date of Patent: Nov. 12, 1991

[54] WATERPROOFING OF POLYESTER FIBERFILL

[75] Inventors: Michael S. Frankosky, Hockessin; George J. Ostapchenko, Wilmington, both of Del.

[73] Assignee: E. I. Du Pont de Nemours and Company, Wilmington, Del.

[21] Appl. No.: 610,438

[22] Filed: Nov. 14, 1990

Related U.S. Application Data

[63] Continuation-in-part of Ser. No. 449,615, Dec. 12, 1989.

[51] Int. Cl.[5] ..... B32B 5/24

[52] U.S. Cl. ..... 428/95; 2/87; 428/74; 428/76; 428/96; 428/201; 428/287; 428/288; 428/296; 428/297; 428/315.5; 428/315.9; 428/316.6; 428/317.5

[58] Field of Search ..... 428/201, 287, 288, 315.5, 428/315.9, 316.6, 317.5, 297, 296, 95, 96

[56] References Cited

U.S. PATENT DOCUMENTS 4,493,870 1/1985 Vrouenraets ..... 428/245
4,725,481 2/1988 Ostapchenko ..... 428/213

FOREIGN PATENT DOCUMENTS 51-111290 10/1976 Japan .

*Primary Examiner*—James C. Cannon

[57] ABSTRACT

A waterproof hydrophilic copolyetherester film having a high water vapor transmission rate can be secured surprisingly well to polyester fiberfill batting, so provides advantages in processing, and provides improved comfort to the wearer when the composite is used in apparel.

4 Claims, No Drawings

WATERPROOFING OF POLYESTER FIBERFILL

CROSS REFERENCE TO RELATED APPLICATION

This application is a continuation-in-part of copending application Ser. No. 07/449,615, filed by Frankosky on Dec. 12, 1989.

FIELD OF INVENTION

This invention concerns improvements in and relating to providing polyester fiberfill with a waterproof coating layer, especially for use in apparel.

BACKGROUND

Polyester fiberfill (sometimes referred to as polyester fiberfilling material) has become well accepted as a reasonably inexpensive filling and/or insulating material, and is manufactured and used in large quantities for pillows, cushions and other furnishing materials, including bedding materials, and in apparel. Polyester fiberfill batting is used commercially in many apparel articles because it is an efficient and economic alternative to down and feather insulation, and it is relatively insensitive to moisture. It is, however, desirable to prevent intrusion by water, for example on cold rainy days, as intrusion by water would detract from the wearer's comfort. This has been the objective.

Conventional waterproofing that prevents perspiration from escaping is not the answer, as this perspiration would eventually collect as a liquid and detract from comfort. Recently, therefore, coatings of various types, including films, have been developed to allow water vapor to pass, but not allow liquid to pass. Generally, such films have been applied or attached to fabrics for use in making "waterproof/breathable" apparel. Such apparel has required, in practice, special seam-sealing wherever fabrics have been joined or attached, such as for arms and pockets. This special seam-sealing has been expensive and has limited design possibilities, and, for sheer fabrics, has been aesthetically objectionable. Also, recently, waterproof/breathable film has been attached to a scrim to be used as a drop-in liner; this approach gave more design freedom and reduced the amount of seam-sealing needed, but the films required special treatment to prepare them for lamination to the scrim and were attached to the scrim in a separate step.

To improve the aesthetics of polyester fiberfill, it has generally been preferred to "slicken" the fiberfill with a coating of durable (e.g., wash-resistant) coating, that has usually been a silicone, i.e., a cured polysiloxane, as disclosed, e.g., by Hofmann, U.S. Pat. No. 3,271,189, Mead et al., U.S. Pat. No. 3,454,422, Ryan, U.S. Pat. No. 3,488,217, Salamon et al., U.S. Pat. No. 4,146,674, Pamm, U.S. Pat. No. 4,281,042, Frankosky, U.S. Pat. No. 4,304,817, and Takemoto Oil & Fat Co. Ltd., Japanese Published Patent Application No. 58-214,585 (1983). The slickener has long presented serious problems in obtaining good adhesion, as discussed in several of these references, such as Pamm and Frankosky.

So, it has long been desirable to provide a practical solution to this problem of waterproofing polyester fiberfill batts, as such or in the form of garments or other articles filled with polyester fiberfill, especially slickened polyester fiberfill, without the defects mentioned.

Another problem has been leakage of the polyester fiberfill through surrounding shell fabric, as described by LeVan in U.S. Pat. No. 4,869,771, which again mentions the problem of getting materials to adhere to slickened polyester fiberfill.

SUMMARY OF INVENTION

Surprisingly, we have now found, according to the present invention, that a film of a particular copolyetherester elastomer that is hydrophilic ca be secured to slickened polyester fiberfill, e.g. in the form of a batt, with attendant advantages, as will be evident hereinafter.

So, according to one aspect of the invention, there is provided a batt of polyester fiberfill, or a garment or other article filled with polyester fiberfill, wherein the polyester fiberfill is secured to a continuous flexible layer of a waterproof hydrophilic elastomer having a water vapor transmission rate of at least 3500 gm.mil/m$^2$/24hrs, according to ASTME96-66 (procedure BW), said hydrophilic elastomer being a copolyetherester elastomer or a mixture of two or more copolyetherester elastomers having a multiplicity of long-chain ester units and short-chain ester units joined head-to-tail through ester linkages, said long-chain ester units being represented by the formula.

$$-\mathrm{OGO}-\overset{\mathrm{O}}{\overset{\|}{\mathrm{C}}}\mathrm{R}\overset{\mathrm{O}}{\overset{\|}{\mathrm{C}}}- \qquad \text{(I)}$$

and said short-chain ester units being represented by the formula:

$$-\mathrm{ODO}-\overset{\mathrm{O}}{\overset{\|}{\mathrm{C}}}\mathrm{R}\overset{\mathrm{O}}{\overset{\|}{\mathrm{C}}}- \qquad \text{(II)}$$

wherein G is a divalent radical remaining after the removal of terminal hydroxyl groups from a poly(alkylene oxide) glycol having an average molecular weight of about 400–3500, and further, the amount of ethylene oxide groups incoporated in the copolyetherester or mixture of two or more copolyetheresters by the poly(alkylene oxide) glycol is from about 25–68 weight percent based upon the total weight of the copolyetherester or mixture of two or more copolyetheresters; R is a divalent radical remaining after removal of carboxyl groups from dicarboxylic acid having a molecular weight less than 300; D is a divalent radical remaining after removal of hydroxyl groups from a diol having a molecular weight less than about 250; and said hydrophilic copolyetherester or mixture of two or more copolyetheresters has from about 25–80 weight percent short-chain ester units.

Advantageously, if desired, the fiberfill is secured to the continuous layer of the hydrophilic elastomer by an intervening layer of a hydrophobic elastomer having a water vapor transmission rate of 400–2500 gm.mil/m$^2$/24hrs, preferably about 800–1200 gm.mil/m$^2$/24hrs, said hydrophobic elastomer is a copolyetherester having a multiplicity of recurring long-chain ester units and short-chain ester units, said long-chain ester units being represented by the formula $$-\mathrm{OGO}-\overset{\mathrm{O}}{\overset{\|}{\mathrm{C}}}\mathrm{R}\overset{\mathrm{O}}{\overset{\|}{\mathrm{C}}}- \qquad \text{(I)}$$

and said short-chain ester units being represented by the formula:

$$-ODO-\overset{O}{\overset{\|}{C}}R\overset{O}{\overset{\|}{C}}- \quad (II)$$

where G is a divalent radical remaining after the removal of terminal hydroxyl groups from a poly(alkylene oxide) glycol having an average molecular weight of about 400–3500, the amount of ethylene oxide groups incorporated in the copolyetherester by the poly(alkylene oxide)glycol is not greater than about 20 weight percent; R is a divalent radical remaining after removal of carboxyl groups from a dicarboxylic acid having a molecular weight less than 300; D is a divalent radical remaining after removal of hydroxyl groups from a diol having a molecular weight less than about and wherein said hydrophobic elastomer preferably has about 25–80 weight percent short-chain ester units. The fiberfill may advantageously be bonded intermittently to the layer of hydrophobic elastomers by spot-bonding or in other discontinuous manner, preferably by use of binder fibers that are of lower melting point.

It will be understood that such aforesaid elastomers may be unitary copolyetherester elastomers, or mixtures of two or more copolyetherester elastomers if desired.

Thus, in one aspect of the invention, the flexible film may comprise more than one elastomer layer. One layer is a hydrophilic elastomer layer, as above. A second layer may be coextruded with the first and may be a hydrophobic elastomer, such as a copolyetherester containing 20.3 weight percent 1.4-butylene terephthalate, 7.9 weight percent 1,4-butylene isophthalate, 51.7 weight percent poly(tetramethylene ether) isophthalate and 20.1 weight percent poly(tetramethylene ether) terephthalate wherein the poly(tetramethylene ether) glycol used had a molecular weight of 2000. Such second layer is more hydrophobic and has a lower melting point, which helps adhesion.

The polyester fiberfill is preferably slickened. The batts etc are preferably of density within the range of 0.5 to 1 pound per cubic foot (about 0.008 to 0.016gm/cu cm), but may be of density up to about 1.5, or up to about 2 lb/cu ft. (about 0.025, or about 0.03 gm/cu cm.) The waterproof fiberfill composites have shown an advantage in their ability to avoid delamination upon stretching and flexing in use over an extended period, such as would be encountered while the apparel is being worn.

Other aspects and advantages of the invention will appear hereinafter.

DETAILED DESCRIPTION OF THE INVENTION

The invention is expected to be particularly useful with the slickened fiberfill described in the foregoing references, the disclosures of all of which are hereby incorporated herein by reference, in particular such blends as described by Frankosky, in U.S. Pat. No. 4,304,817.

Preferred hydrophilic copolyetherester elastomers are those hydrophilic elastomers more particularly described by Ostapchenko in U.S. Pat. No. 4,725,481, the disclosure of which is also hereby specifically incorporated by reference, being an improvement over the art cited therein, such as Vrouenraets et al., U.S. Pat. No. 4,493,870 and Japanese Patent Application No. 50-35623, published Oct. 1, 1976, disclosing less preferred copolyetheresters. In practice, it has been considered necessary to secure films of such copolyetherester elastomers by adhesive techniques, as indicated therein. This is because other methods to secure the films have not been found adequate, in practice. We have found that, when such films have been directly extruded onto a fabric, such as a nonwoven scrim of polyethylene terephthalate fibers, the composites are insufficiently bonded in the sense that, in practice, during subsequent stretching and flexing such as occurs during use, spot delamination occurs, i.e. the bonds between the film and the fabric break locally, so the integrity of such a composite no longer exists all over the interface between the fabric and the film. Surprisingly, however, according to the present invention, polyester fiberfill battings can be better bonded overall to such copolyetherester films, in the sense that the integrity of the interfacial bond stands up better in practice to repeated stretching and flexing. A suitable batt of polyester fiberfill preferably has a low density up to about 0.5 to 1 lb/cu ft, but the density may be up to about 1.5, or even up to about 2 lb/cu ft (corresponding to about 0.008 to 0.016, up to about 0.025, or even about 0.03 gm/cu cm). A batt of fiberfill is not so dense as most fabrics, much less dense even than a nonwoven lightweight scrim (a nonwoven lightweight scrim fabric of spun bonded polyethylene terephthalate such as was used in Example 1 of Ostapchenko U.S. Pat. No. 4,725,481 being about 7 to 7.5 lb/cu ft, i.e. about 0.12 gm/cu cm, for example), and presents fewer contact points to a film. One may speculate that such differences could be important reason for the different and surprising behaviors in practice, although this invention is not intended to be limited to any theory.

The composite according to the invention provides an apparel material that combines both thermal insulation and a barrier to penetration by liquid (water), while allowing water vapor to escape. Preferred materials combine strength with good aesthetics. The materials may be made easily by extrusion of the hot tacky film onto the batting or by a laminating process, such as has been used previously, whichever is desired. When a pre-formed film is laminated to the batting, it is possible to use a solventbased adhesive, but a low melting adhesive is generally preferred, in the form of binder fibers, spot-adhesion or other technique of avoiding a continuous layer of adhesive bonding to the film. The materials may be processed conventionally into garments or articles other than apparel, as desired. An important advantage over prior suggestions is the ability of the new composites to have their seams sealed ultrasonically.

The invention will now be described in the following Examples. All parts and percentages are by weight, unless otherwise indicated. In every case, satisfactory adhesion was obtained between the batting and the waterproof film.

EXAMPLE 1

In Example 1, a 50 yard commercial sample of 3.0 oz/sq yd bonded batting (density about 1 lb/cu ft), made from a triple blend of silicone slickened, dry and binder fibers, was united with a film of a copolyetherester elastomer consisting of 45% butylene terephthalate and 55% of a mixture consisting of 60% polyethylene oxide (molecular weight=2000) terephthalate and 40% of polyethylene oxide/polypropylene oxide (molecular weight=2150, ethylene oxide content=25%)

terephthalate as the film was freshly extruded by a slit die extruder maintained at 229° C. and a die lip opening of about 10 mils. The linear speed of extrusion was about 2 yards per minute, while the take-up rolls were about 15 times faster (30 yards per minute), thereby reducing the film thickness to about 0.7 mil, by the time the film was coated on to the batting. The first contact with the batting occurred at the nip between the two take-up rolls; the lower roll preheated the batting as it carried it to meet the film; the upper (pressure) roll provided a means to drive the film and batting together while cooling the film to cause it to solidify. For this 3.0 ounce batting, adequate adhesion was obtained with negligible loss in batting bulk when the roll carrying the batting was maintained at 80° C. and the pressure/-quench roll was maintained at 60° C.

EXAMPLE 2

In Example 2, all conditions were the same as for Example 1 except that 4.5 ounce batting was used which required different temperatures for the first contact rolls. The temperature of the lower roll carrying the batting was 93° C., while the upper pressure roll was maintained at 60° C.

EXAMPLE 3

In Example 3, film making was separated from lamination. A bilayer film was made by coextruding copolyetherester elastomers (A) and (B) where (A) consisted of 45% butylene terephthalate and 55% of a mixture consisting of 60% polyethylene oxide (molecular weight =2000) terephthalate and 40% of polyethylene oxide/polypropylene oxide (molecular weight =2150, ethylene oxide content =25%) terephthalate, and (B) consisted of 20.3% 1,4-butylene terephthalate, 7.9% 1,4-butylene isophthalate, 51.7% poly(tetramethylene ether) terephthalate and 20.1% poly(tetramethylene ether) isophthalate wherein the poly(tetramethylene ether) glycol used had a molecular weight of 2000. The coextruded film was prepared using a 2.5 inch (6.4 cm) diameter extruder to feed copolyetherester A and a 1.5 (3.8 cm)inch diameter extruder to feed copolyetherester B to a combining block to 3oin the respective polymer melts in a laminar fashion prior to extrusion through a slit die. The 1.5 inch diameter extruder was maintained at 215° C., and the 2.5 inch diameter screw was maintained at 205° C. The die lip opening was set at 10 mils( 0.25 mm) and the die temperature was maintained at 215° C. Coextruded film was produced at a rate of 18 yards (16.6 meters)/min to yield a final film thickness of 0.7 mil (0.018 mm). The ratio of extruder speeds was maintained such that the thickness of copolymer (A) was 0.6 mils and that of copolymer (B) was 0.1 mils.

In a separate operation, a 10 yard commercial sample of batting, like in Example 2, was co-fed with the bilayer film and a non-woven webbing of commercially available low-melting polyester binder fiber into a flat-bed laminating unit which could heat the components from above and below by contact heat from endless belts coated with Teflon ®TFE fluorocarbon. The spacing between the belts was adjusted to avoid compression of the batting. The film contacted the bottom belt and was arranged so that copolymer (B) faced the batting. The adhesive nonwoven was a 0.63 oz/sq yd polyester fabric having a 135° C. mp, available under the trade name "Spunfab Type PE204", and was placed between the film and the batting. The sandwich was processed at about 7 yards (6.4 meters) per minute using a belt temperature of 150° C.

EXAMPLE 4

In Example 4, all conditions for film making were the same as for Example 3. For the laminating step, a 10 yard commercial sample of batting was co-fed into the flat-bed laminating unit without the binder fiber webbing, and with the bilayer film. In place of the nonwoven binder fiber webbing, "Bostik" 5178 Polyester powder was applied at a rate of about 0.5 oz/sq yd onto the film surface. The sandwich was processed at about 7 yards (6.4 meters) per minute using a belt temperature of 150° C.

Griltex EMS 6D2-2 may be used as an adhesive powder, instead of the "Bostik" 5178 Polyester powder.

It is not necessary to apply as much adhesive, and good adhesion has been obtained by applying as little as 0.25 oz/sq yd, it being understood that the precise amount may depend on various factors, such as are known in the art, e.g. type and pattern of application, intended use, aesthetics and materials selected.

These composites have shown excellent waterproof/-breathable qualities, and have not shown a tendency toward spot-delamination such as has been encountered with film bonded to a nonwoven lightweight scrim fabric of spunbonded polyethylene terephthalate that was merely extrusion-coated, i.e. unless the scrim fabric had been spot-adhered using an adhesive to provide a satisfactory bond between the film and the fabric. The film also effectively seals the fiberfill within the oute layer.

We claim:

1. A slickened polyester fiberfill batt or a garment or other article filled with slickened polyester fiberfill, wherein the slickened polyester fiberfill is secured to a continuous flexible layer of a waterproof hydrophilic elastomer having a water vapor transmission rate of at least 3500 gm.mil/m2/24hrs, according to ASTM E96-66 (Procedure BW), said hydrophilic elastomer being a copolyetherester elastomer or a mixture of two or more copolyetherester elastomers having a multiplicity of long-chain ester units and short-chain ester units joined head-to-tail through ester linkages, said long-chain ester units being represented by the formula $$-\mathrm{OGO}-\overset{\overset{\mathrm{O}}{\|}}{\mathrm{C}}\mathrm{R}\overset{\overset{\mathrm{O}}{\|}}{\mathrm{C}}- \qquad \text{(I)}$$

and said short-chain ester units being represented by the formula:

$$-\mathrm{ODO}-\overset{\overset{\mathrm{O}}{\|}}{\mathrm{C}}\mathrm{R}\overset{\overset{\mathrm{O}}{\|}}{\mathrm{C}}- \qquad \text{(II)}$$

where G is a divalent radical remaining after the removal of terminal hydroxyl groups from a poly(alkylene oxide) glycol having an average molecular weight of about 400–3500, and further, the amount of ethylene oxide groups incorporated in the copolyetherester or mixture of two or more copolyetheresters by the poly(alkylene oxide) glycol is from about 25–68 weight percent based upon the total weight of the copolyetherester or mixture of two or more copolyetheresters; R is a divalent radical remaining after removing of carboxyl groups from a dicarboxylic acid having a molecular weight less than 300; D is a divalent radical remaining after removal of hydroxyl groups from a diol having a molecular weight less than about 250; and said hydrophilic copolyetherester or mixture of two or more copolyetheresters has from about 25–80 weight percent short-chain ester units.

2. A slickened polyester fiberfill batt or garment or other article according to claim 1, wherein the fiberfill is secured to said continuous flexible layer of said hydrophilic elastomer via an intervening layer of a hydrophobic elastomer having a water vapor transmission rate of 400–2500 gm.mil/m$^2$/24hrs, said hydrophobic elastomer is a copolyetherester elastomer or a mixture of two or more copolyetherester elastomers having a multiplicity of recurring long-chain ester units and short-chain ester units, said long-chain ester units being represented by the formula:

$$-\mathrm{OGO}-\overset{\overset{\mathrm{O}}{\|}}{\mathrm{C}}\mathrm{R}\overset{\overset{\mathrm{O}}{\|}}{\mathrm{C}}- \qquad \text{(I)}$$

and said short-chain ester units being represented by the formula:

$$-\mathrm{ODO}-\overset{\overset{\mathrm{O}}{\|}}{\mathrm{C}}\mathrm{R}\overset{\overset{\mathrm{O}}{\|}}{\mathrm{C}}- \qquad \text{(II)}$$

where G is a divalent radical remaining after the removal of terminal hydroxyl groups from a poly(alkylene oxide) glycol having an average molecular weight of about 400–3500, the amount of ethylene oxide groups incorporated in the copolyetherester by the poly(alkylene oxide)glycol is not greater than about 20 weight percent; R is a divalent radical remaining after removal of carboxyl groups from a dicarboxylic acid having a molecular weight less than 300; and D is a divalent radical remaining after removal of hydroxyl groups from a diol having a molecular weight less than about 250; and said hydrophobic copolyetherester or mixture of two or more copolyetheresters has from about 5–80 weight percent short-chain ester units.

3. A slickened polyester fiberfill batt or garment or other article according to claim 2, wherein the fiberfill is discontinuously bonded to said hydrophobic elastomer by an adhesive.

4. A slickened polyester fiberfill batt or garment or other article according to claim 3, wherein said hydrophobic elastomer is bonded to the fiberfill by means of binder fibers having a melting point that is lower than that of the polyester fiberfill and lower than that of said hydrophobic elastomer.

* * * * *